US008879369B2

(12) United States Patent
Takasawa

(10) Patent No.: US 8,879,369 B2
(45) Date of Patent: Nov. 4, 2014

(54) TIMEPIECE FACEPLATE, AND ELECTRICAL TIMEPIECE EQUIPPED WITH SOLAR BATTERY

(71) Applicant: Seiko Epson Corporation, Tokyo (JP)

(72) Inventor: Koki Takasawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 13/922,631

(22) Filed: Jun. 20, 2013

(65) Prior Publication Data

US 2014/0029392 A1 Jan. 30, 2014

(30) Foreign Application Priority Data

Jul. 30, 2012 (JP) ..... 2012-168858

(51) Int. Cl.

| | |
|---|---|
| ***G04B 45/00*** | (2006.01) |
| ***G04C 10/02*** | (2006.01) |
| ***G04G 17/00*** | (2013.01) |
| ***G04B 19/06*** | (2006.01) |
| ***G04B 19/10*** | (2006.01) |
| ***G04B 19/12*** | (2006.01) |

(52) U.S. Cl.

CPC ..... *G04B 45/0076* (2013.01); *G04C 10/02* (2013.01); *G04G 17/00* (2013.01); *G04B 19/06* (2013.01); *G04B 19/10* (2013.01); *G04B 19/12* (2013.01)

USPC ..... 368/232; 368/234; 368/205

(58) Field of Classification Search

USPC ..... 368/205, 223, 232, 234

See application file for complete search history.

(56) References Cited

U.S. PATENT DOCUMENTS

| | | | | |
|---|---|---|---|---|
| 6,455,140 | B1 * | 9/2002 | Whitney et al. | 428/212 |
| 6,475,609 | B1 * | 11/2002 | Whitney et al. | 428/212 |
| 8,202,634 | B2 * | 6/2012 | Kitamura | 428/699 |
| 2008/0159083 | A1 * | 7/2008 | Kawakami | 368/232 |
| 2012/0044788 | A1 * | 2/2012 | Takasawa | 368/205 |
| 2012/0155225 | A1 * | 6/2012 | Takasawa et al. | 368/223 |
| 2013/0094333 | A1 * | 4/2013 | Ito et al. | 368/239 |

FOREIGN PATENT DOCUMENTS

| | | |
|---|---|---|
| JP | 2010-054303 A | 3/2010 |

* cited by examiner

*Primary Examiner* — Amy Cohen Johnson
*Assistant Examiner* — Matthew Powell
(74) *Attorney, Agent, or Firm* — Global IP Counselors, LLP

(57) ABSTRACT

To provide a timepiece faceplate having appropriate light permeability with excellent aesthetic appearance having glittering property, and an electrical timepiece equipped with a solar battery, a timepiece faceplate of the invention includes a faceplate main body that has light permeability, and a glittering layer that is provided on either one of a front surface side and a back surface side of the faceplate main body and is configured by dispersing a glittering powder into a light permeable resin. The glittering powder is configured by laminating a metallic oxide film above one surface side of a plate shaped base material, which has light permeability, and the glittering powder is a lamination powder that an average grain diameter is more than 10 μm and less than 90 μm.

4 Claims, 4 Drawing Sheets

TIMEPIECE FACEPLATE, AND ELECTRICAL TIMEPIECE EQUIPPED WITH SOLAR BATTERY

CROSS-REFERENCE TO RELATED APPLICATIONS

This application claims priority to Japanese Patent Application No. 2012-168858 filed on Jul. 30, 2012. The entire disclosure of Japanese Patent Application No. 2012-168858 is hereby incorporated herein by reference.

BACKGROUND

1. Technical Field

The present invention relates to a timepiece faceplate and an electrical timepiece equipped with a solar battery.

2. Background Technology

Timepiece faceplates require not only practicality such as visibility but also decorative aspects (an aesthetic appearance). A processed metal plate and a base plate mad by plastic on which a coating, a metal-plating, or the like was applied have been used as the timepiece faceplates. Also, the timepiece faceplates having more excellent aesthetic appearance, which cannot be obtained by only the metal plate or the metal-plating, are desired.

On the other hand, electrical timepieces equipped with a solar battery receive increased recognition from the viewpoints of the easiness of maintenance and the natural resources saving. The timepiece faceplates used for the timepieces equipped with a solar battery require light permeability so that adequate amount of light is transmissive to generate enough electromotive force for the solar battery arranged in a bottom side of the timepiece faceplate. Because of this, light permeable materials such as a plastic, a ceramic, a glass, and the like have been used for this intended purpose of the timepiece faceplates. However, the light permeable materials described above generally lack a sense of luxury and are less aesthetic appearance compare to metallic materials such as gold, silver, and the like.

As a technique by using the light permeable materials that the timepiece faceplates have excellent appearance with a sense of gloss, the compositions including powder and a hardening resin are applied to the surface of the faceplate main body by a screen printing, and a hardened part is formed by hardening the hardening resin. It is well known that the timepiece faceplates use this as an index (see Patent Document 1 as an example). The powder in Patent Document 1 is provided with a metal film configured by the metal materials on both sides of the base part, and it is obtained by forming the metal film on the both surfaces of the sheet material, which is made by the plastic, by a vapor phase deposition method, and after that, cutting it in a size becoming an average grain diameter of 100 to 155 μm. By the way, the index has a function indicating time and there are various marks such as characters, numbers (that is, time characters), scales, codes, and the like.

Japanese Laid-open Patent Publication No. 2010-54303 (Patent Document 1) is an example of the related art.

SUMMARY

Problems to be Solved by the Invention

However, when a layer made by the powder and the hardened resin of Patent document 1 as described above is formed on not only a part of the faceplate surface such as an index and is formed in a broad area, the adequate light permeability cannot be secured in the timepiece faceplate used for the electric timepiece equipped with the solar battery so that it had a difficult problem to obtain both light permeability and glittering property.

An object of the invention is to provide a timepiece faceplate having appropriate light permeability with excellent aesthetic appearance having glittering property, and an electrical timepiece equipped with a solar battery.

Means used to Solve the Above-Mentioned Problems

A timepiece faceplate of the invention has a faceplate main body having a light permeability and a glittering layer, in which the glittering powder disperses into the light permeable resin, provided on any one of the front and back surfaces of the timepiece faceplate. The glittering powder is characterized by including a laminated powder in an average grain diameter of more than 10 μm and less than 90 μm configured by laminating metal-oxide films on only one surface side of a base plate of a plate having the light permeability.

According to the invention, the average grain diameter of the glittering powder is less than 90 μm and it reflects finely compare to the large size powder in the average grain diameter so that a sense of luxury of the timepiece faceplate can be improved. Also, it is easy to adjust the transmissivity of entire timepiece faceplate. By the way, the average grain diameter of the glittering powder is set less than 90 μm so as to slightly reduce the glistering property compare to the large size powder. In this point, it has a configuration that the films are laminated on only one surface side of the plate shaped base material so that a surface refraction index of the glittering powder becomes high. Also, the degree of reflection is improved so that the glittering property, which is not different from the large size powder in the average grain diameter, is obtained. Also, the average grain diameter of the glittering powder is set more than 10 μm because if the powder was in the average grain diameter of less than 10 μm, the powder can be easily agglutinated so that the glittering powder can be unevenly dispersed into the light permeable resin and the aesthetic appearance obtained in the timepiece faceplate can be weak.

By the way, in the present application, the average grain diameter means the average of the values of the maximum length criteria of the powder as long as there is no specific indication. In the measurement of the powder, any given area including powder is taken as an image and the maximum length of respective powder is calculated from the particle image of the powder in the range of the taken image data.

Also, the metal-oxide film used for the glittering powder is possible for the transmission of light so that the light permeability of the timepiece faceplate is improved. And, the metal-oxide film having the light permeability is laminated on only one surface side of the plated shape base material having the light permeability so that the glittering powder reflects light. With that, it has a half mirror function to transmit a part of light so that the light permeability of the glittering layer becomes high. As a result, the glittering property of the timepiece faceplate can be improved. Therefore, the timepiece faceplate having appropriate light permeability with excellent aesthetic appearance having glittering property can be provided.

It is preferable that the timepiece faceplate of the invention is provided on any one surface side of the front and back surfaces of the faceplate main body or any one surface side of the front and back surfaces of the glittering layer, and has a colored layer having a light permeability.

According to the invention, when it is viewed, a feel of a material of the glittering layer is possible to be changed by providing the colored layer having the light permeability so that various types of timepiece faceplate having a sense of luxury can be provided.

It is preferable that in the timepiece faceplate of the invention, the light transmissivity of the entire timepiece faceplate is more than 15% and less than 40%.

According to the invention, in a case that the transmissivity of the entire timepiece faceplate is more than 15%, the timepiece faceplate having the light permeability that does not block generating efficiency of the solar battery can be provided. Also, in a case that the transmissivity of the entire timepiece faceplate is less than 40%, for example, it can prevent the timepiece faceplate from seeing through the circuit configuration of the solar battery when it is located opposite surface side (back surface side of the timepiece) of the visual recognition surface (timepiece front surface) of the timepiece faceplate when viewing the timepiece faceplate from the visual recognition surface side (timepiece front surface side). Thus, the appearance when the faceplate of the timepiece is viewed can be improved. By the way, the light transmissivity of the entire timepiece faceplate as described above is adjustable by the mixture fraction of the light glittering powder included in the glittering layer.

The electrical timepiece equipped with the solar battery of the invention includes the timepiece faceplate of the invention and the solar battery provided on the back surface side of the timepiece faceplate.

According to the invention, the timepiece faceplate has appropriate light permeability with excellent aesthetic appearance having glittering property so that it does not block generating efficiency of the solar battery. Thus, the electronic timepiece equipped with the solar battery having excellent light permeability can be provided.

BRIEF DESCRIPTION OF THE DRAWINGS

Referring now to the attached drawings which form a part of this original disclosure:

FIG. 2A is a light microscope picture diagram of a taken image of the glittering layer; FIG. 2B is a diagram showing a color-coded condition in an area that a light permeable resin is existed; and FIG. 2C is a diagram showing occupancy of the glittering powder by counting the color-coded areas;

DETAILED DESCRIPTION OF EXEMPLARY EMBODIMENTS

The preferred embodiments of the invention will be explained in reference to the drawings.

First Embodiment

Configuration of the Timepiece Faceplate

Figure 1:
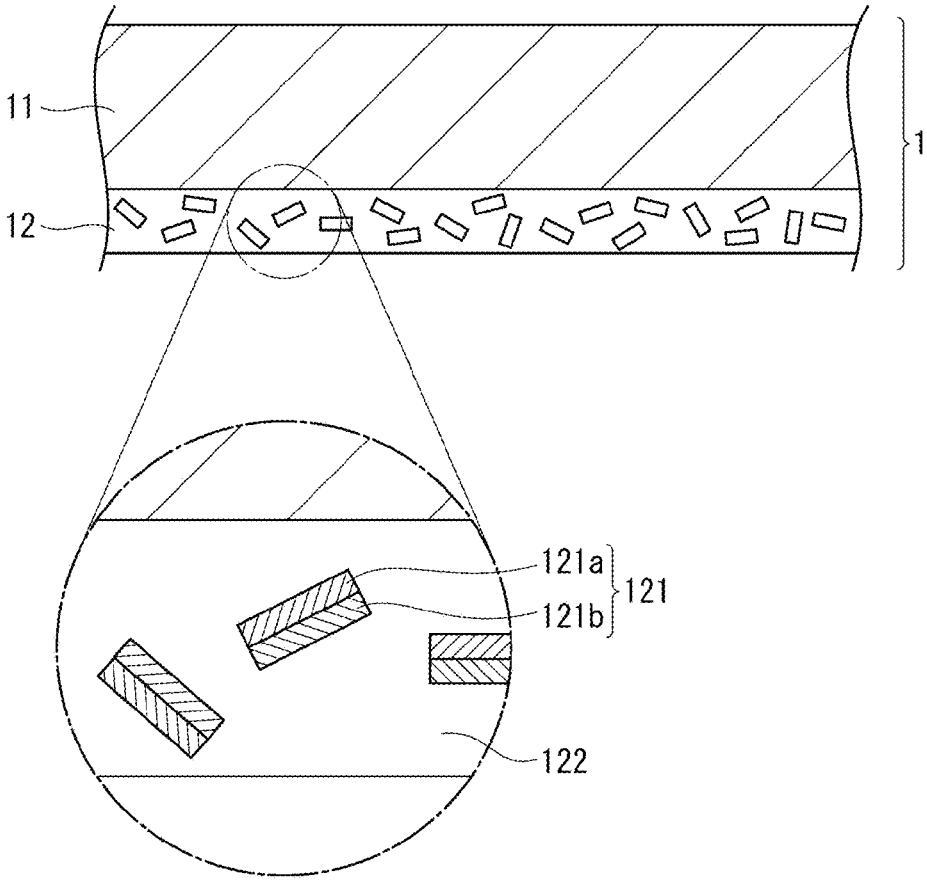
FIG. 1 is a schematic diagram showing a cross-section of a timepiece faceplate of the first embodiment.

FIG. 1 is a schematic diagram showing a cross-section of a timepiece faceplate 1 of the first embodiment. The timepiece faceplate 1 includes a faceplate main body 11 having a light permeability, and a glittering layer 12, which configures the glittering powder 121 dispersed into a light permeable resin 122, provided on the opposite surface side (timepiece back surface side) of the visual recognition surface (timepiece front surface) of the faceplate main body 11.

[Configuration of the Faceplate Main Body]

The faceplate main body can be configured by any materials, but it can be configured by a material having light permeability. Because of this, the timepiece faceplate 1 has excellent aesthetic appearance with excellent light permeability and it can be applied to effectively use for a solar timepiece faceplate (faceplate in a case of timepiece equipped with a solar battery). In the invention, the phrase "having light permeability" refers to having a property in which at least a portion of light in the visible light region (wavelength region of 380 to 780 nm) is transmitted; the transmissivity of light in the visible light region is preferably 50% or more; and more preferably, the transmissivity of light in the visible light region is 60% or more. By using white fluorescent light (FL20S-D65: a fluorescent light for examination manufactured by Toshiba Corp.) as the light source, an electric current value (A) when power is generated at 1000 lux only by a solar cell (solar battery) having the same shape as the base plate to be measured is obtained. Also, an electric current value (B) when power is generated in the same state except that the base plate to be measured is placed on the light source side of the solar cell is obtained. Then, the ratio of $((B/A)\times 100[\%])$ obtained as above can be used as light transmissivity. Also, regarding the light transmissivity for the timepiece faceplate as described later, it can be obtained in the same manner as described above. Hereinafter, in the present specification, the phrase "having light permeability" is indicated to a value in this condition as long as there is no specific indication.

The faceplate main body 11 includes, for example, various plastics materials and various glass materials, but the faceplate main body 11 is preferably composed mainly of a plastic material. Plastic materials generally have excellent moldability (degree of freedom of molding), and can be advantageously used for manufacturing the timepiece faceplate 11 in various shapes. Also, a faceplate main body 11 composed of plastic material is advantageous for reducing the manufacturing cost of the timepiece faceplate 1. Further, plastic materials generally have excellent light (visible light) transmissivity, and also have excellent radio wave transmissivity. Therefore, when the faceplate main body 11 is composed of a plastic material, the timepiece faceplate 1 can be advantageously applied to a radio timepiece. The focus of the description below is an example in which the faceplate main body 11 is mainly composed of a plastic material. In the invention, the term "mainly" refers to a component present in the greatest amount content among the materials constituting the parts (members) under discussion. The content is not particularly limited, but is preferably 60 wt % or more, more preferably 80 wt % or more, and even more preferably 90 wt % or more of the material constituting the part (member) under discussion.

The plastic material constituting the faceplate main body 11 can be any of a variety of thermoplastic resins, thermosetting resins, or the like. For example, this includes polycarbonate (PC), acrylonitrile-butadiene-styrene copolymer (ABS resin), polymethyl methacrylate (PMMA), and other acrylic resins; polyethylene (PE), polypropylene (PP), and other polyolefin resins; polyethylene terephthalate (PET) and other polyester resins; epoxy resins; urethane resins; and copolymers, blends, polymer alloys, or the like composed mainly of these. Also, one or more of these can be used in combination (e.g., blend resins, polymer alloys, laminates, and the like). Specifically, it is particularly preferred that the faceplate main body 11 be mainly composed of at least one of polypropylene and acrylonitrile-butadiene-styrene copolymer (ABS resin). Because of this, the strength of the timepiece faceplate 1 overall can be made particularly excellent. Also, degree of freedom of molding for the faceplate main body 11 increases (improving the easiness of molding) so that even though the timepiece faceplate 1 has complicated shapes, it can be manufactured easily and reliably. Also, the faceplate main body 11 contains materials including at least one selected from polycarbonate (PC) and ABS resin so that adhesion between the faceplate main body 11 and the glittering layer 12 can be particularly excellent. Also, the faceplate main body 11 contains materials including at least one selected from polycarbonate (PC) and ABS resin so that adhesion between the faceplate main body 11 and the glittering layer 12 can be particularly excellent. Also, among various plastic materials, polycarbonate (PC) is relatively reasonable price so that the production cost of the timepiece faceplate 1 can be reduced. Also, the ABS resin has particular excellent chemical proof so that it can further improve endurance of the timepiece faceplate 1 overall.

By the way, the faceplate main body 11 can include components other than the above described. Examples of such components include plasticizers, antioxidants, colorants (including various color formers, fluorescent substances, phosphorescent substances, and the like), brighteners, and fillers. For example, when the faceplate main body 11 is composed of a material that includes a colorant, color variations of the timepiece faceplate 1 can be increased.

The faceplate main body 11 can have an essentially uniform composition in each part, or can have a different composition depending on the part. For example, the faceplate main body 11 can be configured with the base plate and a coating layer placed on the base plate.

Also, a shape of the faceplate main body 11 is not limited to a particular size, and normally, it is determined based on a shape and a size of the timepiece faceplate 1. By the way, in the configuration of the drawings, the faceplate main body 11 is a flat shape, but it can be, for example, curved shape.

Also, a shape of the faceplate main body 11 is not limited to a particular size, and normally, it is determined based on a shape and a size of the timepiece faceplate 1. By the way, in the configuration of the drawings, the faceplate main body 11 is a flat shape, but it can be, for example, curved shape.

An average thickness of the faceplate main body 11 is not limited to a particular thickness, but it is preferably more than 150 μm and less than 700 μm, and more preferably more than 200 μm and less than 600 μm, and furthermore, it is preferred 250 μm and less than 500 μm. When the average thickness of the faceplate main body 11 is in such above described ranges, in a case that the timepiece faceplate 1 applies to a solar timepiece, the light permeability of the timepiece faceplate 1 keeps high adequately so that it can effectively prevent a timepiece faceplate from seeing through a color of the solar battery body itself. Thus, a particular excellent aesthetic appearance can be obtained. Also, when a thickness of the faceplate main body 11 is a value in the above described ranges, it can efficiently prevent a timepiece, which applies with the timepiece faceplate 1, from becoming thicker, and a mechanical strength, stability of a shape, and like of the timepiece faceplate 1 can be adequately excellent.

Also, the faceplate main body 11 can be molded using any method, but examples of molding methods of the faceplate main body 11 include compression molding, extrusion molding, injection molding, photo fabrication, or the like.

Also, for the front and back surfaces of the faceplate main body 11, examples of the surface treatments include mirror-like finishing, parallel grooves-like finishing, stain finishing, or the like. Because of this, it is possible to have variations of texture of the obtained timepiece faceplate 1 so that the excellent aesthetic appearance of the timepiece faceplate 1 can be improved.

Also, a lyophilic treatment, a liquid-repellent treatment can be applied on a part of the front and back surfaces of the faceplate main body 1. Because of this, the glittering layer 12 can be easily and reliably formed on a desired part on the faceplate main body 11.

Also, prior to forming the glittering layer 12, various wash treatments can be applied to the front and back surfaces of the faceplate main body 11. Because of this, adhesiveness between the faceplate main body 11 and the glittering layer 12 can be particularly excellent.

[Configuration of Glittering Layer]

The glittering layer 12 is configured by dispersing the glittering powder 121 into the light permeable resin 122. The glittering powder 121 is configured by laminating the metallic oxide films 121*b* on only one surface side of the plate shaped base material 121*a* having the light permeability, and it is the laminated powder having the average grain diameter of more than 10 μm and less than 90 μm.

Examples of constituent materials of the plate shaped base material 121*a* include glasses or resins. The examples of the glasses include fused quartz, soda glass, or the like. The examples of the resins include various thermoplastic resins, and various thermo-setting resins.

Examples include polyethylene, polypropylene, ethylene-propylene copolymer, polyolefins (EVA) such as ethylene-vinyl acetate copolymer, cyclic polyolefin, modified polyolefin, polyvinyl chloride, polyvinylidene chloride, polystyrene, polyamide (e.g., nylon 6, nylon 46, nylon 66, nylon 610, nylon 612, nylon 11, nylon 12, nylon 6-12, nylon 6-66), polyimide, polyamide-imide, polycarbonate (PC), poly-(4-methylpentene-1), ionomer, acrylic resin, polymethyl methacrylate, acrylonitrile-butadiene-styrene copolymer resin (ABS resin), acrylonitrile-styrene copolymer resin (AS resin), butadiene-styrene copolymer, polyoxymethylene, polyvinyl alcohol (PVA), ethylene-vinyl alcohol copolymer (EVOH), polyethylene terephthalate (PET), polybutylene terephthalate (PBT), polyesters such as polycyclohexane terephthalate (PCT), polyether, polyether ketone (PEK), polyether ether ketone (PEEK), polyetherimide, polyacetal (POM), polyphenylene oxide, modified polyphenylene oxide, polysulfone, polyether sulfone, polyphenylene sulfide, polyarylate, aromatic polyester (liquid crystal polymer), polytetrafluoroethylene, polyvinylidene, other fluoride resins, styrene, polyolefin, polyvinyl chloride, polyurethane, polyester, polyamide, polybutadiene, trans-polyisoprene-based, fluororubber-based, various thermoplastic elastomers of chlorine polyethylene-based, epoxy resin, phenol resin, urea resin, melamine resin, unsaturated polyester, silicone resin, urethane resin, and polyparaxylylene resins such as poly-para-xylylene(poly-para-xylylene), poly-monochloro-para-xylylene(poly-monochloro-para-xylylene), poly-dichloro-para-xylylene(poly-dichloro-para-xylylene), poly-monofluoro-para-xylylene (poly-monofluoro-para-xylylene), and poly-monoethyl-para-xylylene(poly-monoethyl-para-xylylene). Also, it can include copolymer, blend, polymer alloy, or the like consisting mainly of these materials, and among these materials, more than one or two can be combined for use (e.g., blend resin, polymer alloy, laminated body, or the like).

The average thickness of the plate shaped base material 121*a* is preferably more than 0.1 μm and less than 5.0 μm, and more preferably more than 0.5 μm and less than 5.0 μm.

The metallic oxide film 121*b* is laminated on only one surface side of the plate shaped base material 121*a*.

By the way, when the metallic oxide film 121*b* is laminated on both surface sides of the plate shaped based material 121*a*, it becomes difficult that the glittering powder obtains a part of light transmission function so that it can be difficult to increase the light permeability of the glittering layer 12.

The metallic oxide materials composed of the metallic oxide film 121*b* are $TiO_2$, $Al_2O_3$, MgO, and $CrO_2$.

An average thickness of the metallic oxide film 121*b* is preferably more than 0.01 μm and less than 3.0 μm, and more preferably more than 0.02 μm and less than 2.0 μm.

When the average thickness of the metallic oxide film 121*b* is in the above described ranges, it effectively prevents the plate shaped base material 121*a* from relatively thinning the thickness, and in the glittering powder 121, a texture of the metallic oxide material composed of the metallic oxide film 121*b* can be adequately demonstrated. Because of this, the aesthetic appearance of the timepiece faceplate 1 can be particularly excellent.

Also, by changing the thickness of the metallic oxide film 121*b* in the ranges described above, it becomes possible to present various color representation so that the color of the glittering powder 12 is not only white color but also yellow color, green color, red color, blue color, and the like.

Also, by controlling the thickness of the metallic oxide film 121*b* in nanometer-order, a production color of an interference color can be realized by the light interference effect.

By the way, when the average thickness of the metallic oxide film 121*b* is less than the lower limit, the glittering property of glittering powder 121 can be reduced. On the other hand, when the average thickness of the metallic oxide film 121*b* is more than the higher limit, it is difficult the glittering powder 121 to obtain a function transmitting a part of light so that it becomes difficult to improve the light permeability of the glittering layer 12.

It is preferred that the above described glittering powder 121 is produced as follows. That is, the glittering powder 121 forms the metallic oxide layer (the metallic oxide layer corresponding to the thickness of the metallic oxide film 121*b*) on one surface of a sheet material made by a glass or a resin (thickness of the sheet material corresponding to the thickness of the plate shaped base material 121*a*) by a vapor coating method such as vacuum based deposition, sputtering, ion plating, or the like. After that, it is preferred that it is obtained by cutting or crushing it in a predetermined size (size corresponding to the average grain diameter of the glittering powder 121). Because of this, the adhesion between the plate shaped base material 121*a* and the metallic oxide film 121*b* becomes excellent, and the glittering powder 121 that the aesthetic appearance is excellent can be easily and reliably obtained.

Also, the average grain diameter of the glittering powder 121 is in a range more than 10 μm and less than 90 μm. Among them, it is preferred that the average grain diameter of the glittering powder 121 is more than 15 μm and less than 60 μm, and more preferably, more than 20 μm and less than 40 μm.

By setting the average grain diameter in the above ranges, the glittering powder 121 in the glittering layer 12 can effectively reflect light as a diamond or a cut glass so that the aesthetic appearance of the timepiece faceplate 1 can be excellent.

Also, the excellent light permeability can be applied to the glittering layer 12 compare to the large grain size more than 100 μm in the average grain diameter so that it is possible to adjust an appropriate transmissivity to the entire timepiece faceplate 1.

On the other hand, when the average grain diameter of the glittering powder 121 is less than the lower limit, the glittering property can be reduced. Also, the solar battery located in the lower layer of the timepiece faceplate 1 can be seen through so that it lacks a sense of luxury.

Meanwhile, when the average grain diameter of the glittering powder 121 is more than the higher limit, the light permeability is reduced and also, the adjustment of the light transmissivity of the timepiece faceplate 1 itself can be difficult so that it lacks a sense of luxury.

The light permeable resin 122 is used in the uncured state or the partially-uncured state in the production step of the glittering layer 12.

As the light permeable resin 122, a resin material which becomes hardened by an energy line (e.g. heat (heat ray), light (light including ultraviolet rays, or the like other than optical wavelength), an electron beam) can be used, and for example, thermo-setting resin, photo-curable liquid crystal, electron beam curable resin, or the like can be used. More specifically, various hardening resins such as phenolic resin, epoxy resin, melamine resin, urea resin, unsaturated polyester resin, alkyd resin, urethane resin (polyurethane), acrylic resin, or the like can be used.

When a light hardening resin is used as the light permeable resin 122, the productivity of the timepiece faceplate 1 can be particularly excellent. Also, at the time of the production, it can absolutely prevent the constituent material of the timepiece faceplate 1 from degradation, or the like so that the reliability of the produced timepiece faceplate 1 can be particularly excellent.

The mixing ratio of the glittering powder and the light permeable resin is preferably in a range more than 15 weight % and 70 weight %.

The composition can include a constituent material other than the glittering powder 121 and the light permeable resin 122. As such constituent material, for example, it can be various solvents (having a function to disperse the glittering powder as disperse media), a dispersing agent, or a thermoplastic resin.

As the solvents, it is not particularly limited, but one or combination of two of various solvents such as cyclohexane, n-hexane, n-pentane, ethanol, isopropanol, n-butanol, isophorone, ethylene glycol monobutyl ether, or the like can be used. Among them, when one or more than two selected from a group consisting of cyclohexane, isophorone, and ethylene glycol monobutyl ether can be used as the solvents, the glittering powder can be steadily dispersed in the composition, and the flow property of the glittering powder in the composition becomes particularly excellent.

In the composition, when the glittering layer 12 is formed, it is preferable to appropriately adjust the mixture ratio of the glittering powder 121 and the light permeable resin so that the occupancy of the glittering powder 121 in any given area becomes more than 30% and less than 100%. When the occupancy of the glittering powder 121 is in the above range, the glittering appearance can be evenly appeared in the entire timepiece faceplate 1. The glittering powder 121 of the invention has a function transmitting a part of the light so that the influence to the light permeability is very little. It is approximately 10% of the attenuation effect so that it has a flexibility that can use a decorative element.

By the way, even when the occupancy of the glittering powder 121 is 100%, the glittering powder 121 of the invention has a function transmitting a part of light so that adequate light amount to generate electro motive force of the solar battery 103 located on the lower surface side of the timepiece faceplate 1 can be transmitted. On the other hand, when the occupancy is less than 30%, the glittering property is reduced so that the appearance of the timepiece faceplate can be weak.

FIG. 2 is an explanatory diagram showing the occupancy of the glittering powder in a given area of the glittering layer. (A) is a light microscope picture diagram of a taken image of the glittering layer. (B) is a diagram showing a color-coded condition in an area that a light permeable resin is existed. (C) is a diagram showing occupancy of the glittering powder by counting the color-coded areas.

The occupancy of the glittering powder 121 in a given area of the glittering layer can be calculated as follows.

First, the formed glittering layer 12 is taken as an image. Here, the surface layer of the glittering layer 12 can be taken as an image, or the cut surface where any position of the glittering layer 12 was cut can be taken as an image. The imaging method is preferably the light microscope.

Figure 2A:
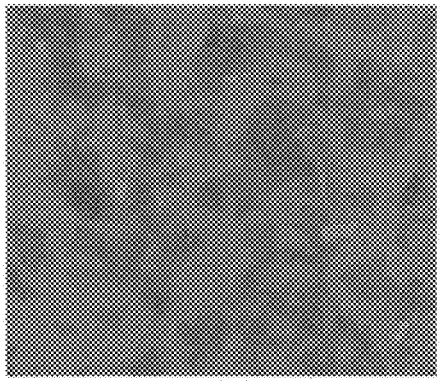
FIGS. 2A-2C are explanatory diagrams showing occupancy of the timepiece faceplate of the first embodiment of the invention.

Next, as shown in FIG. 2A, any given area is set for an imaging area, and the set area becomes the entire area.

Figure 2B:
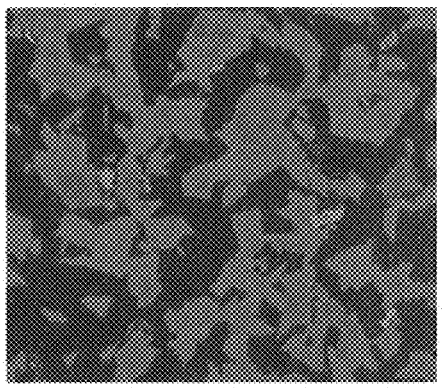

Next, an area that the glittering powder 121 is existed and an area that the light permeable resin 122 is existed are separated. The color coding method is preferable for the method for separating because it is easily recognizable. In FIG. 2B, an image processing is performed for the area that the light permeable resin 122 is existed by the color coding so that respective areas are separated.

Figure 2C:
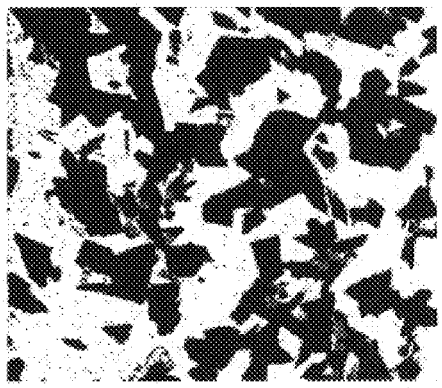

And, as shown in FIG. 2C, the respective areas that were separated are counted. And, the counted areas are respectively calculated, and they are combined. In addition, by calculating the difference between the entire area and the combined separated areas, the content rate of the glittering powder in any given area can be calculated. In FIG. 2C, the total area ratio is calculated as 49.65% so that it can recognize that the occupancy is 50%.

[Manufacturing Process of Glittering Layer]

The glittering layer 12 is manufactured by that the composition including the glittering powder 121 and the light permeable resin 122 is applied on the faceplate main body 11, and it can be formed by hardening the light permeable resin 122. The application of the composition is not limited as long as it is the method that can apply it in an entire area of the faceplate main body 11.

The hardening of the light permeable resin 122 is performed by the method in response to the type of the light permeable resin. For example, when the light permeable resin is the thermohardening resin, it is performed by heating. When the light permeable resin is the photo-curable resin, it is performed by irradiating light (energy line).

The light permeability of the entire timepiece faceplate 1 of the invention obtained by this means is more than 15% and less than 40%.

[Schematic Configuration of Electrical Timepiece Equipped with Solar Battery]

Figure 3:
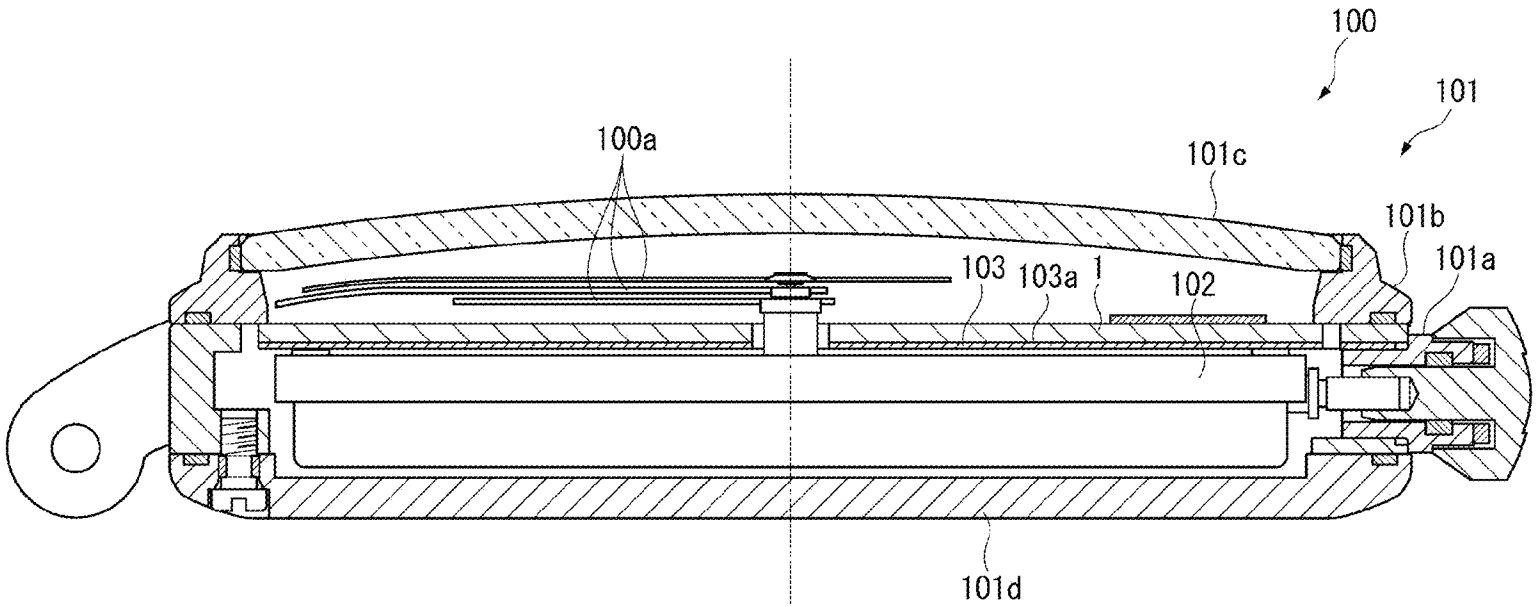
FIG. 3 is a cross-sectional view of an electrical timepiece equipped with a solar battery according to the present embodiment.

FIG. 3 shows a cross-sectional diagram of the electric timepiece equipped with solar battery 100 having a timepiece faceplate.

The electrical timepiece equipped with solar battery 100 is an index type wristwatch (analog timepiece) showing time by driving index 100*a*. The electric timepiece equipped with solar battery 100 has an exterior case 101, a movement 102, which has built-in various configurations driving the index 100*a*, stored in the exterior case 101, a solar battery 103, and a timepiece faceplate 1.

The exterior case 101 has a cylindrical casing 101*a*, a ring-like bezel 101*b* fixed on the surface side of the casing 101*a*, a cover glass 101*c* held by the bezel 101*b*, and a back lid 101*d* fixed on the back surface side of the casing 101*a*.

The casing 101*a*, the bezel 101*b*, and the back lid 101*d* are composed of metal materials such as, for example, stainless steel, brass, titanium, or the like. The cover glass 101*c* is composed of the base material made by sapphire.

The movement 102 is fixed on inner circumference side so as to store it in the casing 101*a*.

The movement 102 has a step motor or the like, and this is the general movement to drive the index 100*a* or the like.

The solar battery 103 is arranged on the movement 102, and on top of that, the timepiece faceplate 1 is arranged. The acceptance surface 103*a* of the solar battery 103 is opposed to the glittering layer 12 of the timepiece faceplate 1.

Effect of the Present Embodiment

According to the above described embodiment, the following effects are achieved.

(1) The glittering powder 121 that configures the glittering layer 12 is the lamination powder, which is in the average grain diameter of more than 10 μm and less than 90 μm, configured by laminating the metallic oxide film 121*b* on only one surface side of the plate shaped base material 121*a* which has the light permeability. Therefore, the timepiece faceplate 1 having excellent aesthetic appearance, which includes the glittering property, and having appropriate light permeability as well can be provided.

(2) The light transmissivity of the entire timepiece faceplate 1 is more than 15% and less than 40% so that it does not block the generating efficiency of the solar battery 103, and the light permeability is excellent.

(3) The electric timepiece equipped with solar battery has the timepiece faceplate 1, which is excellent aesthetic appearance including the glittering property and has appropriate light permeability as well, so that the electric timepiece equipped with solar battery that does not block the generating efficiency of the solar battery 103 and has excellent light permeability, can be provided.

Second Embodiment

Figure 4:
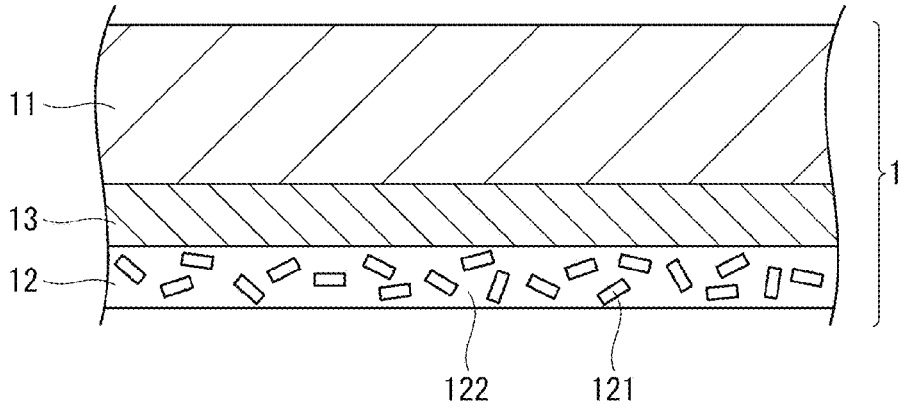
FIG. 4 is a schematic drawing showing a cross-section of the timepiece faceplate of the second embodiment of the invention.

Next, the second embodiment of the invention will be described in reference to FIG. 4. FIG. 4 is a schematic diagram showing a cut surface of the timepiece faceplate of the second embodiment. In the present embodiment, a coloring layer 13 having the light permeability is provided between the faceplate main body 11 and the glittering layer 12. Other than this point, the timepiece faceplate of the present embodiment is formed in the same manner as the first embodiment.

It is preferred to form the coloring layer 13 having the light permeability by coating a resin including colorant. The color hue of the coloring layer 13 can be selected any color. The thickness of the coloring layer 13 is preferably in a range of more than 1 μm and less than 20 μm.

For example, if the color of the coloring layer 13 is white, by combining with whitish yellow of the glittering layer 12, the appearance of the timepiece faceplate 1 can be realized as the pearl color.

Also, if the color of the coloring layer 13 is black color, by combining with white color of the glittering layer 12, the appearance of the timepiece faceplate 1 can be realized as the metal-like shine.

In addition, if the color of the coloring layer is red, by combining with white color of the glittering layer 12, the appearance of the timepiece faceplate 1 can be realized as deep pink.

Because of this, various high-class timepiece faceplates 1 can be provided by the color combination of the glittering layer 12 and the coloring layer 13 or the position arrangement of the coloring layer 13.

According to the present embodiment, in addition to the same effects (1) to (3) as described in the first embodiment, the following effect can be obtained.

(4) The timepiece faceplate 1 has the coloring layer 13 including the light permeability so that it is possible to change texture of the glittering layer when viewed. Therefore, various types of high-class timepiece faceplate 1 can be provided.

Modification Example of the Present Embodiment

The invention is not limited to the above described embodiments so that it is possible to perform various changes and modifications in a range that achieves the advantage of the invention.

For example, in FIG. 1, there was a configuration that the glittering layer 12 was provided opposite surface side (back surface side of the timepiece) of the viewed surface (front surface of the timepiece) of the faceplate main body 11, but the glittering layer 12 can be provided on the viewed surface (front surface of the timepiece) of the faceplate main body 11.

Also, in FIG. 4, there was a configuration that the coloring layer 13 was provided between the faceplate main body 11 and the glittering layer 12, but the coloring layer 13 can be provided on the viewed surface side (front surface side of the timepiece) of the faceplate main body 11 or on opposite surface side (back surface side of the timepiece) of the viewed surface (front surface of the timepiece) of the glittering layer 12.

Also, there was a configuration that the glittering layer 12 was provided in one layer, but it can be configured more than two glittering layers. In this case, the glittering layers can be the same configuration, or it can be different configuration.

Embodiments

Embodiment 1

First, by pressing a plate material, in which polycarbonate is the base material, into shapes, a base plate having a shape of the timepiece faceplate was provided and after that, the necessary parts were cut out and polished. The obtained base plate was approximate discotic and it was diameter: 27 mm×thickness: 500 μm. This was the faceplate main body. By the way, in the light transmissivity of the faceplate main body, when white fluorescent light (FL20S-D65: a fluorescent light for examination manufactured by Toshiba Corp.) as the light source was used, the visible light transmissivity was more than 80%.

Next, the faceplate was washed. As washing the faceplate, first, alkali immersion defatting was performed for 30 seconds, and after that, neutralization was performed for 10 seconds. The water washing was performed for 10 seconds, and the purified water washing was performed for 10 seconds.

The composition including the glittering powder, the uncured thermo-setting resin (urethane resin), and cyclohexane, isophorone and ethylene glycol monobutyl ether as solvents is applied to entire surface of the back surface of the faceplate main body that was washed such ways.

As the composition composed of the glittering powder, a composition laminated $TiO_2$ film on one surface side of the plate shaped base material in the average grain diameter 30 μm was used.

Such glittering powder was obtained as follows. First, by vacuum based deposition, the metallic oxide layer composed of $TiO_2$ was formed on a sheet material (average thickness: 2 μm) which is composed of glass. Next, such sheet material was grinded by a grinder such as a mill. Next, a sieve having a plurality of different apertures was prepared and to become a product in the average grain diameter of 30 μm, the ground product was passed through the plurality of sieves so that the glittering powder in the desired average grain diameter was obtained by the screening.

By the way, the average thickness of the metallic oxide layer (metallic oxide film) provided on only one surface side of the sheet material composed of glass was 0.5 μm. Also, as the used solvents, the equal amount (equal weight) of cyclohexane, isophorone and ethylene glycol monobutyl ether were mixed. In addition, the viscosity of the composition at 25° C. was 17000 cps.

Next, the faceplate main body in which the composition was applied was heated in the oven at 80° C. for 30 minutes, and by hardening the hardening resin, the glittering layer was formed on the back side of the faceplate main body. Because of this, the timepiece faceplate as shown in FIG. 1 was obtained.

In the obtained timepiece faceplate, the average thickness of the glittering layer was 15 μm.

By the way, in the timepiece main body, the thickness of the glittering layer was measured according to the microscopic examination of cross section method in reference with JIS H 5821 as standard.

Embodiments 2 to 5, Comparative Examples 1 to 8

The timepiece faceplate was produced in the same manner as embodiment 1 except the configuration changes as shown in the following table 1.

TABLE 1

| | Glittering Powder | | | Timepiece Faceplate | | |
|---|---|---|---|---|---|---|
| | | | | Appearance Evaluation | | |
| | Lamination Film Type | Lamination Plane to Plate Shaped Base Material | Average Grain Diameter [μM] | Glossy Appearance | Appearance Evaluation | Light Permeability |
| Embodiment 1 | $TiO_2$ | One surface | 30 | A | A | C |
| Embodiment 2 | $TiO_2$ | One surface | 50 | B | B | C |
| Embodiment 3 | $Al_2O_3$ | One surface | 45 | B | A | C |

TABLE 1-continued

| | Glittering Powder | | | Timepiece Faceplate | | |
|---|---|---|---|---|---|---|
| | | | | Appearance Evaluation | | |
| | Lamination Film Type | Lamination Plane to Plate Shaped Base Material | Average Grain Diameter [μM] | Glossy Appearance | Appearance Evaluation | Light Permeability |
| Embodiment 1 | $CrO_2$ | One surface | 10 | C | C | C |
| Embodiment 5 | $TiO_2$ | One surface | 87 | C | C | C |
| Comparative Example 1 | $TiO_2$ | One surface | 2 | E | D | D |
| Comparative Example 2 | $Al_2O_3$ | One surface | 5 | D | D | D |
| Comparative Example 3 | $CrO_2$ | One surface | 5 | D | D | D |
| Comparative Example 4 | $TiO_2$ | One surface | 100 | E | E | A |
| Comparative Example 5 | $Al_2O_3$ | One surface | 120 | E | E | A |
| Comparative Example 6 | $TiO_2$ | One surface | 200 | F | E | A |
| Comparative Example 7 | $TiO_2$ | Both surfaces | 40 | C | B | E |
| Comparative Example 8 | Al | Both surfaces | 65 | C | B | E |

Evaluation

1. Appearance Evaluation of the Timepiece Faceplate 1-1. Glittering Evaluation

Regarding each timepiece faceplate produced in each embodiment and each comparative example, a surface side provided with the glittering layer of the timepiece faceplate is arranged opposing to the black color solar battery. In this condition, it is visually observed from the faceplate main body side of the timepiece faceplate, and these appearances were evaluated in accordance with 7 stages standard below.

A: Extremely excellent appearance
B: Excellent appearance
C: Very good appearance
D: Good appearance
E: Slightly not-good appearance
F: Not-good appearance
G: Extremely not-good appearance 1-2. Appearance Comprehensive Evaluation Regarding each timepiece faceplate produced in each embodiment and each comparative example, by performing observation by visual and microscope, these appearances were evaluated in accordance with 5 stages standard below.

A: Extremely fineness
B: Excellent fineness
C: Good fineness
D: Slightly not-good fineness
E: Not-good fineness 2. Light Permeability Evaluation of the Timepiece Faceplate Regarding each timepiece faceplate produced in each embodiment and each comparative example, the light permeability was evaluated by the following method.

First, the solar battery and each timepiece faceplate were stored in a darkroom. After that, to the acceptance surface in a single solar battery, light was irradiated from the white fluorescent lamp (light source) in a predetermined distance. In this case, the electric generation current of the solar battery was A [mA]. Next, in a condition that the faceplate for wristwatch was overlapped, light was irradiated on top of the acceptance surface of the solar battery from the white fluorescent lamp (light source) in a predetermined distance in the same manner as the previous description. In this condition, the electric generation current of the solar battery was B [mA]. And, the light transmissivity of the timepiece faceplate shown as (B/A)×100 was calculated and it was evaluated in accordance with 5 stages standard below. As the light transmissivity is larger, the light permeability of the timepiece faceplate becomes excellent. By the way, the timepiece faceplate was overlapped with the solar battery so that the surface provided with the dispersion layer of the timepiece main body was set toward the white fluorescent lamp (light source) side. Also, the white fluorescent lamp (FL20S-D65: a fluorescent light for examination manufactured by Toshiba Corp.) was used.

A: more than 32%
B: more than 26% and less than 32%
C: more than 20% and less than 26%
D: more than 15% and less than 20%
E: less than 15%

As is clear from table 1, the result that the timepiece faceplate of the invention of the embodiments has appropriate light permeability with excellent aesthetic appearance having glittering property was obtained.

On the other hand, in the comparative examples 1 to 3 that used the glittering powder having the average grain diameter of less than 10 μm, it resulted that the glittering property was low and the aesthetic appearance was weak.

Also, in the comparative examples 4 to 6 that used the glittering powder having the average grain diameter of more than 90 μm, it resulted that the adequate light permeability was not secured so that it was not appropriate for the electric timepiece equipped with solar battery.

In the same manner, in the comparative example 7 that used the glittering powder in which the metallic oxide was laminated on both surfaces of the plate shaped base material, and also in the comparative example 8 that used the glittering powder in which the metallic film was laminated, it resulted that the adequate light permeability was not secured so that it was not appropriate for the electric timepiece equipped with solar battery.

What is claimed is:

1. A timepiece faceplate comprising:

a faceplate main body that has light permeability; and a glittering layer that is provided on either one of a front surface side and a back surface side of the faceplate main body and is configured by dispersing a glittering powder into a light permeable resin;

wherein the glittering powder is configured by laminating a metallic oxide film above one surface side of a plate shaped base material, which is light permeable, and the glittering powder is a lamination powder with an average grain diameter between 10 μm and 90 μm.

2. The timepiece faceplate according to claim 1, further comprising a coloring layer that is light permeable and is formed on either one of the front surface and the back surface of the faceplate main body, or either one of a front surface and a back surface of the glittering layer.

3. The timepiece faceplate according to claim 1, wherein a light transmissivity of the entire timepiece faceplate is between 15% and 40%.

4. An electric timepiece equipped with solar battery comprising:

the timepiece faceplate according to claim 1, and a solar battery provided on a back surface side of the timepiece faceplate.

* * * * *